US005599092A

United States Patent [19]

Yen

[11] Patent Number: 5,599,092

[45] Date of Patent: Feb. 4, 1997

[54] HANGING DECORATION LAMP WITH AN ACTIVE SCENERY

[76] Inventor: Johnson Yen, No. 189, Min Tsu W. Rd., Taipei, Taiwan

[21] Appl. No.: 525,028

[22] Filed: Sep. 8, 1995

[51] Int. Cl.[6] ..... F21V 29/00

[52] U.S. Cl. ..... 362/294; 362/96; 362/373; 362/806

[58] Field of Search ..... 362/96, 294, 373, 362/437, 806, 811, 35; 40/406, 407, 409, 410, 441

[56] References Cited

U.S. PATENT DOCUMENTS

| | | | |
|---|---|---|---|
| 3,166,973 | 1/1965 | Healey | 362/811 |
| 4,190,312 | 2/1980 | Bailey | 362/96 |
| 4,942,504 | 9/1990 | Brotz | 362/811 |
| 5,410,463 | 4/1995 | Jean et al. | 362/806 |

*Primary Examiner*—Y. My Quach

*Attorney, Agent, or Firm*—Beveridge, DeGrandi, Weilacher & Young, L.L.P.

[57] ABSTRACT

A hanging decoration lamp with an active scenery disposed inside a transparent shell of a lamp constituting an illumination bulb has a plurality of glittering flakes and light grains made of foamed polystyrene. The transparent shell has a lid disposed at the top thereof and having a number of holes through which air can convect. The glittering flakes and light grains are made to move actively inside the shell as a result of air convection and the electrostatic force produced by the illumination bulb, making the scenery to appear vivid and active.

10 Claims, 5 Drawing Sheets

HANGING DECORATION LAMP WITH AN ACTIVE SCENERY

BACKGROUND OF THE INVENTION

The present invention relates to a hanging decoration lamp with an active scenery. A plurality of glittering flakes and light grains made of foamed polystyrene are housed inside a transparent shell of the decoration lamp. As a result of the heat produced by the bulb housed inside the shell of the lamp as well as the electrostatic force therein, air convection and the electrostatic force will cause the glittering flakes and grains to actively move, creating a vivid and fascinating effect. To cope with particular seasonal atmosphere, such as Christmas holidays, several lamps in accordance with the present invention can be placed on a decorative string to be placed onto a Christmas tree with seasonal decoration dolls and other seasonal items attached thereto.

Hanging decoration lamps are commonly used with color ribbons by people on special seasonal occasions to create a cheerful and celebratory atmosphere all over the world, especially to decorate Christmas trees on Christmas holidays each year.

Referring to FIG. 1, a typical hanging decoration lamp to be set on a Christmas tree is shown. Such decoration lamp is made of glass with a fixed drawing sketched on the surface thereof in accordance with the specific occasions celebrated. The sketches on the lamp are relatively faint and become useless after the seasonal festivals.

SUMMARY OF THE INVENTION

Therefore, the primary object of the present invention is to provide a hanging decoration lamp with active scenery disposed inside a transparent shell of the lamp including a plurality of glittering flakes and small light grains made of foamed polystyrene that can move as a result of air convection and the electrostatic force in the transparent shell of the lamp. The bulb further having a plurality of miniature seasonal articles housed therein, making the scenery movable in a fascinating manner.

DETAILED DESCRIPTION OF THE PREFERRED EMBODIMENT

Figure 1:
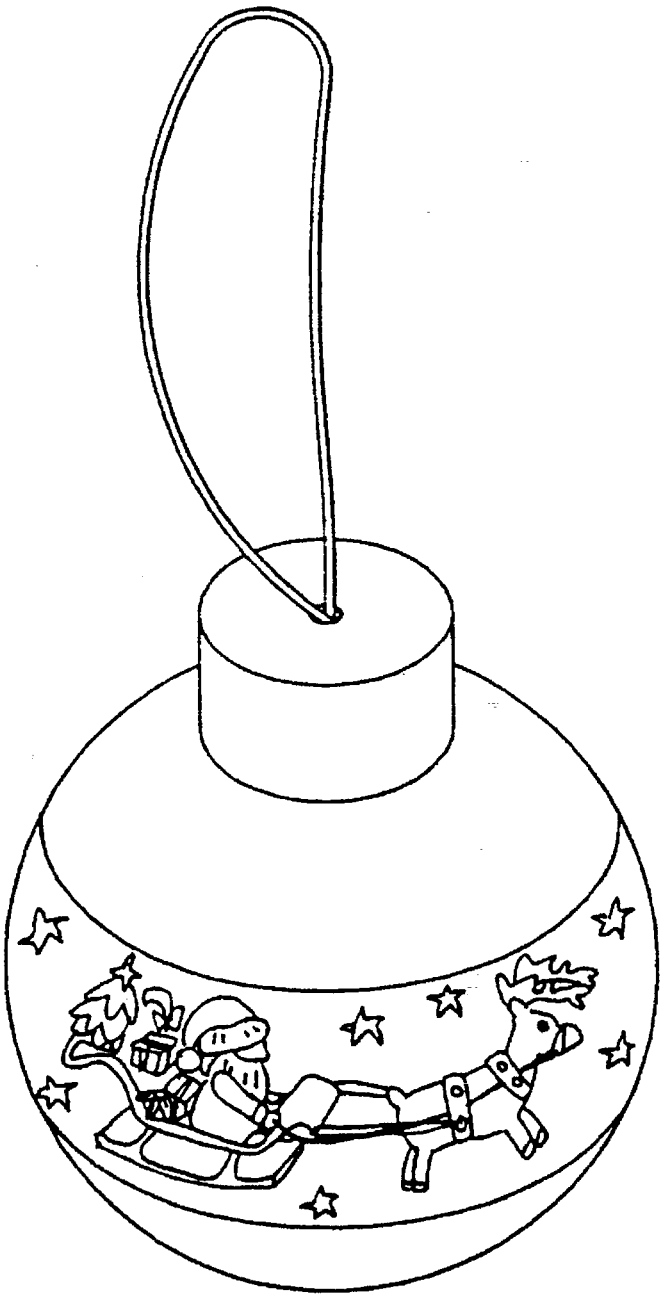
Fig. 1 Prior Art
FIG. 1 is a diagram showing a conventional hanging decoration lamp with fixed scenery.
Figure 2:
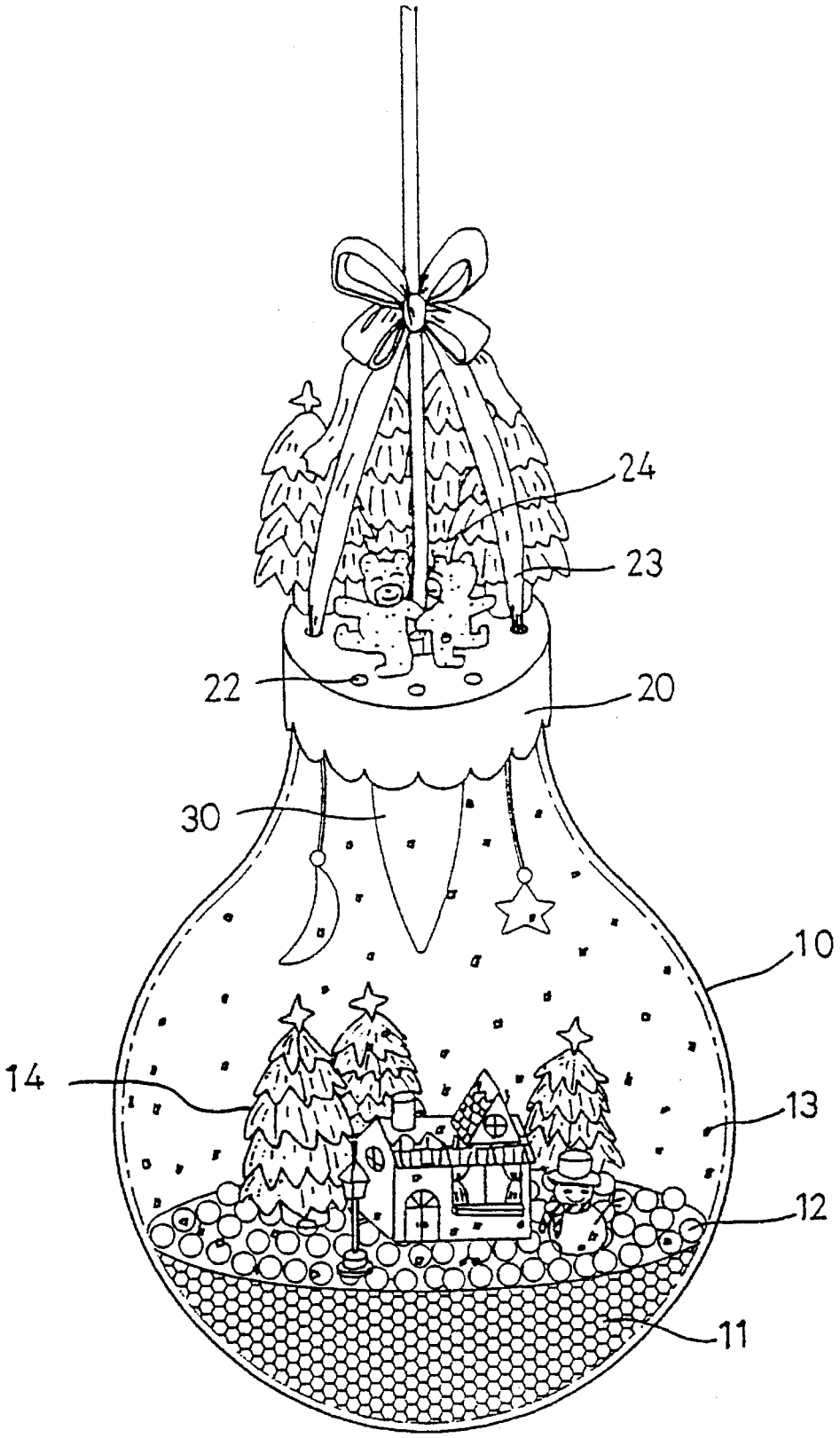
FIG. 2 is a diagram showing an active scenery of the present invention disposed inside a transparent shell of a hanging decoration lamp.
Figure 3:
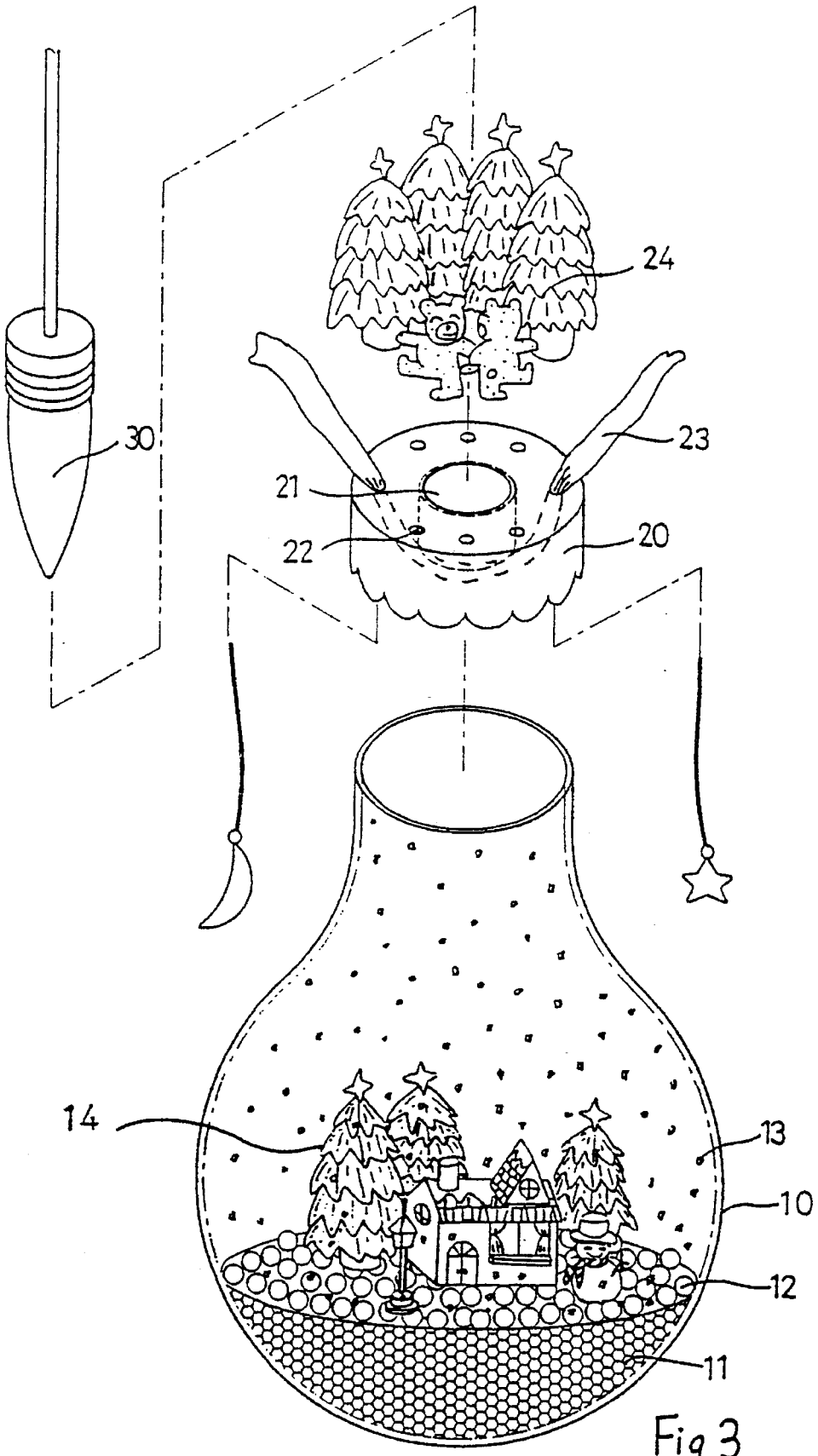
FIG. 3 is a diagram showing the exploded components of the present invention.

Referring to FIGS. 2, 3, the present invention is comprised of a shell 10, a lid 20 and a bulb 30. The shell 10 made of transparent glass has a hollow spherical shape with a layer of sponge 11 located at the bottom thereof. A number of miniature articles 14 creating a seasonal atmosphere are placed on top of the sponge 11 with a plurality of light grains 12 made of foamed polystyrene and tiny glittering flakes 13 which look like snow flakes in the winter.

The lid 20 has a bulb fixing mount 21 at the center and a number of holes 22 on the periphery thereof through which heat is dissipated, causing hot air in the lamp to convect with the external cold air. A color ribbon 23 or cord is attached to the lid 20 through the holes 22 to permit a number of small decorational items or dolls 24 to be secured in place and varied in accordance with seasonal festivals and holidays.

The bulb 30 taken from one of a string of decoration bulbs such as those typically used on a Christmas tree, is screwedly engaged with the lid 20.

The lid 20 having a bulb 30 and decorative items or dolls 24 mounted thereto is secured to the top opening of the shell 10 by adhesive, and the color ribbon 23 is neatly tied up to the electric wire of the bulb 30. The bulb 30 disposed inside the shell produces heat when energized. After the light bulb 30 is energized, its electrical energy will constantly be converted into thermal energy. This will cause the temperature of the air in the shell 10 to increase, wherein the heated air will begin to rise, carrying with it some of the flakes 13 and light grains 12. The heated air will flow through the holes 22 on the lid 20 and cooler outside air will flow into the shell 10 through holes 22 due to the partial vacuum created by the rising heated air. Therefore, the tiny glittering flakes 13 and light grains 12 made of polystyrene, which are naturally electrostatically charged, will circulate within the shell 10 due to the inward and outward flow of air. This will cause the glittering flakes 13 and the light grains 12 to collide with each other, resulting in an increase of electrostatic charges within the shell 10. The flakes 13 will adhere to the wall of the shell due to electrostatic charges on the flakes 13 and the charging electrostatically of the shell 10 due to the constant collision and friction with the charged grains 12 and flakes 13. The flakes therefore will look like natural snow flakes in the winter. The present invention not only produces illumination but also creates a charming scenery view.

Figure 4:
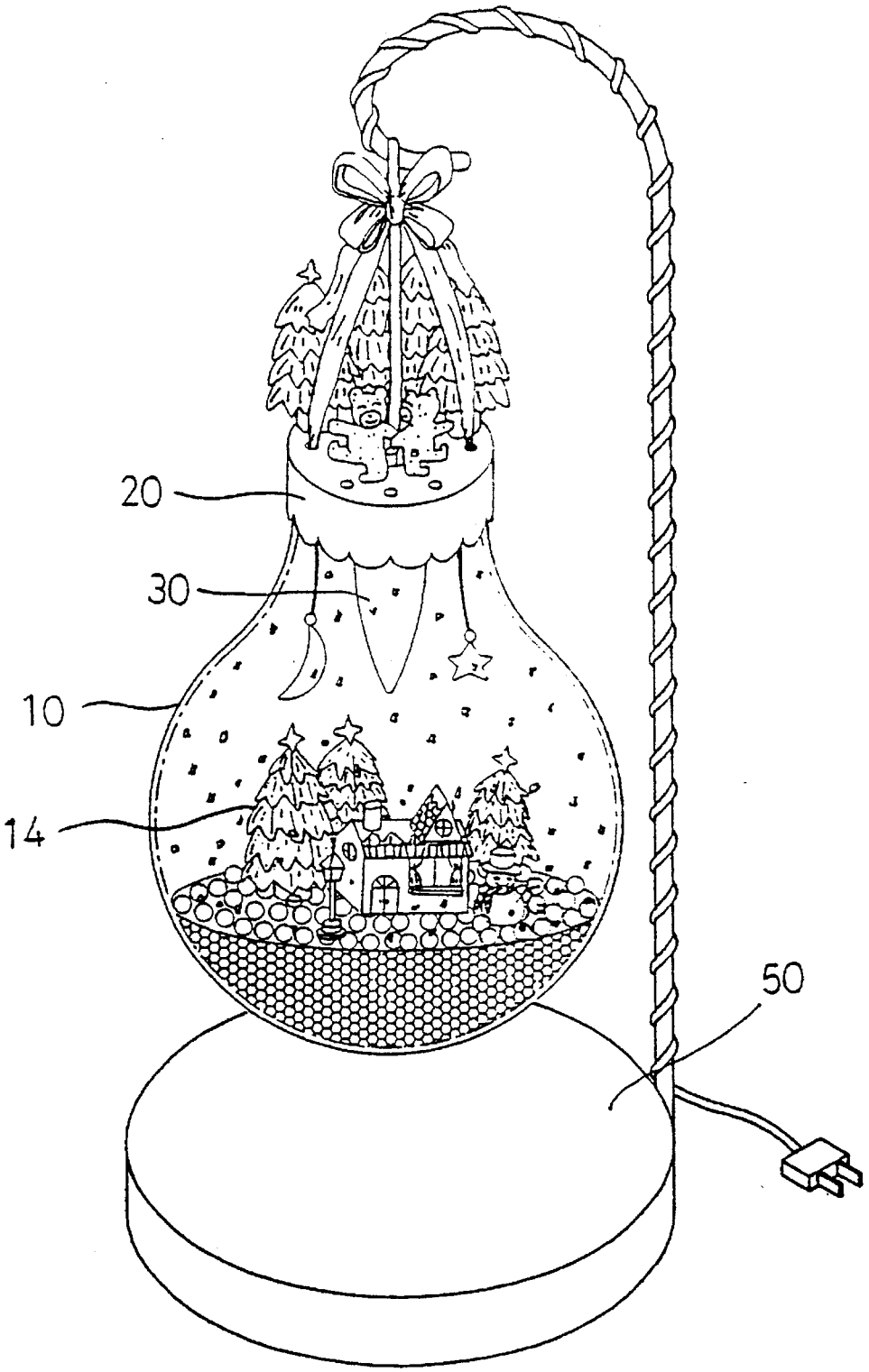
FIG. 4 is a diagram showing a first application of the present invention.

In FIG. 4, an example of an application of the present invention is shown. The decoration lamp of the present invention is suspended from a lamp stand 50 and is used as an illumination light.

Figure 5:
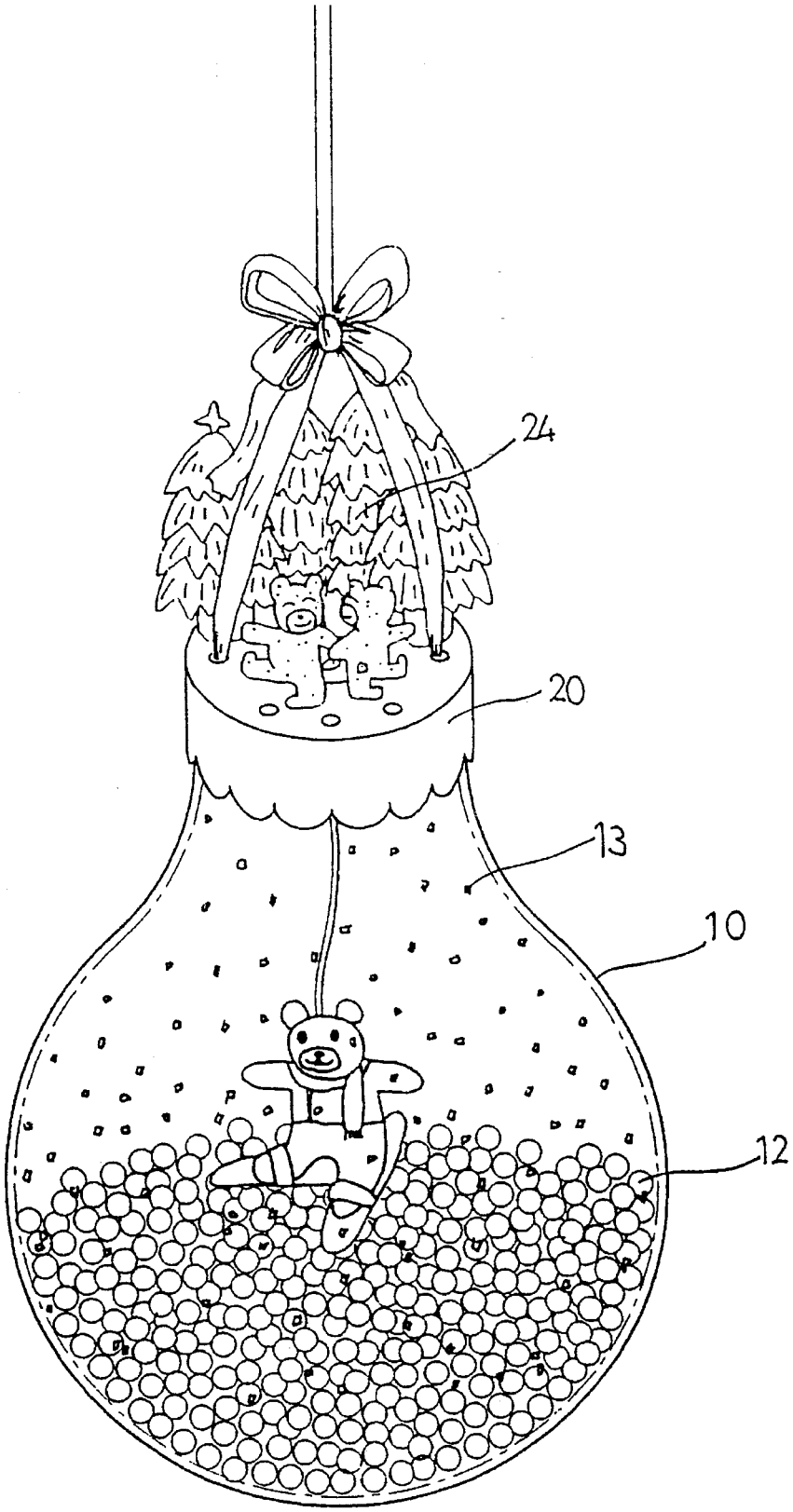
FIG. 5 is a diagram showing another application of the present invention.

As further shown in FIG. 5, another example of application is illustrated wherein the shell 10 is filled at the bottom thereof with light grains 12 of foamed polystyrene and glittering flakes 13 and a lid 20 having a doll hanging therefrom and decoration items or dolls 24 are attached to the top thereof.

I claim:

1. A hanging lamp decorated with active scenery, comprising:

a transparent shell having an opening;

a lid removably connected to said opening of said shell and having a plurality of apertures;

a light bulb removably attached to said lid and extending into said shell; and a multiplicity of glittering flakes and a multiplicity of light grains formed of foamed polystyrene disposed inside said shell, whereby when said light bulb is energized and illuminated and generating heat, heated air within said shell flows outwardly from said shell through said plurality of apertures in said lid while cooler air flows into said shell through said apertures due to the partial vacuum within said shell caused by the outward flow of heated air, such cold and heated air flow resulting in the convection of air within the shell and causing movement of said glittering flakes and said light grains within said shell.

2. A hanging lamp decorated with active scenery as claimed in claim 1 wherein said lamp is engaged with a lamp stand so that said lamp can be used both as an illumination and decoration means.

3. A hanging lamp decorated with active scenery as claimed in claim 1 wherein said apertures permitting air to pass therethrough in convection and permitting cords to go therethrough to secure small decoration items to said lid of said lamp.

4. A hanging lamp decorated with active scenery as defined in claim 3 wherein said decoration items are dolls.

5. A hanging lamp decorated with active scenery as defined in claim 1, further comprising:

at least one decoration disposed within said shell.

6. A hanging lamp decorated with active scenery as defined in claim 5, further comprising:

a layer of sponge disposed in said shell and supporting said at least one decoration thereon.

7. A hanging lamp decorated with active scenery as defined in claim 1, further comprising:

at least one ornament fastened to a top of said lid.

8. A hanging lamp decorated with active scenery as defined in claim 7, further comprising:

a ribbon having its ends passing through two of said apertures on the lid and fastening to an electric wire connecting to said bulb.

9. A hanging lamp decorated with active scenery as defined in claim 1, wherein:

said light bulb has a threaded base, said lid has a central threaded aperture, and said threaded base of said light bulb threadingly engages said central threaded aperture, whereby said light bulb is held in position within said shell.

10. A hanging lamp decorated with active scenery as defined in claim 1, wherein:

said glittering flakes and said light grains are naturally electrostatically charged, whereby collisions between said glittering flakes and said light grains increases the electrostatic charges causing an inner surface of said shell to become electrostatically charged and said glittering flakes to adhere to the inner surface of the shell.

* * * * *